US006283879B1

(12) United States Patent
Eden et al.

(10) Patent No.: US 6,283,879 B1
(45) Date of Patent: Sep. 4, 2001

(54) MODIFIED LACROSSE STICK FOR PLAYING ROLLERCROSS TYPE GAME

(75) Inventors: Robert Eden, Palm Springs; Tim Lowry, Burbank, both of CA (US)

(73) Assignee: Eden Enterprises, Las Vegas, NV (US)

( * ) Notice: Subject to any disclaimer, the term of this patent is extended or adjusted under 35 U.S.C. 154(b) by 0 days.

(21) Appl. No.: 09/265,899

(22) Filed: Mar. 11, 1999

Related U.S. Application Data

(60) Provisional application No. 60/077,558, filed on Mar. 11, 1998.

(51) Int. Cl.[7] ..... A63B 59/02
(52) U.S. Cl. ..... 473/513; 473/471
(58) Field of Search ..... 473/513, 512, 473/514, 471, FOR 204

(56) References Cited

U.S. PATENT DOCUMENTS 3,591,178 7/1971 Milligan et al. .
5,035,434 * 7/1991 Taylor et al. ..... 473/513
5,080,372 1/1992 Brine, III et al. .
5,174,580 * 12/1992 Pratt ..... 473/513
5,494,297 2/1996 MacNeil .
5,568,925 10/1996 Morrow et al. .
5,651,744 * 7/1997 Millon et al. ..... 473/513
5,938,550 * 8/1999 Hexemer et al. ..... 473/513
5,967,912 * 10/1999 Taylor et al. ..... 473/513

FOREIGN PATENT DOCUMENTS

374133 * 4/1923 (DE) ..... 273/FOR 204

* cited by examiner

*Primary Examiner*—Mark S. Graham
(74) *Attorney, Agent, or Firm*—Hoffman, Wasson & Gitler

(57) ABSTRACT

A lacrosse-type stick provided with a frame including a top portion and two side portions. A netting is attached to the frame and a lip portion is attached to one of the side portions. The purpose of this lip portion is to direct a lacrosse ball into the netting. A flat portion is also attached to one of the side portions for the purpose of striking the ball when it is on the ground.

17 Claims, 6 Drawing Sheets

MODIFIED LACROSSE STICK FOR PLAYING ROLLERCROSS TYPE GAME

The present application claims the priority of Provisional Patent Application Ser. No. 60/077,558, filed on Mar. 11, 1998.

BACKGROUND OF THE INVENTION

Dating back to the 15th century, American Indians played lacrosse. The game's main purpose was to settle tribal disputes and more importantly, to prepare and toughen warriors for battle. Legend has it that team selection and victories were supernaturally controlled. Equipment and players are still ritually prepared by ceremonies that resemble those practiced before departing on the war path. Non-Indians witnessing this game likened the sticks used to play the game to the "crosier", which were carried by bishops as a symbol of their office. Hence the name lacrosse. In the 1800's in Montreal, non-Indians took up the game lacrosse and has since been designated as the national sport of Canada. The United States, England, Ireland, Scotland and Australia all play lacrosse and compete on the international level. Touted as the fastest game on two feet, lacrosse is considered to be an arduous test of strength and endurance.

Due to its cold winter weather, Canadians also participated greatly in the sport of ice hockey, which is considered to be the fastest game on two skates. Obviously, since ice hockey is placed on ice, it's playing time is limited to outdoor rinks or ponds in cold weather, as well as indoor rinks both in warm and cold weather. However, due to the rapid increase in popularity of ice hockey, particularly in the United States, rink time is often difficult to obtain and is limited in nature.

The invention of inline skates brought the world the ultimate cross training mechanism for ice hockey. Although conventional roller skates have been used to play a floor version of hockey, inline skates most closely simulates the moves on ice and the uncompromising maneuverability that makes ice hockey so fast and exciting. Now a viable sport in its own right, and the fastest-growing team sport in America at the present time, inline roller hockey has captured the majority of the inline market.

The organizations that support the sport of inline hockey have nurtured the ranks of recreational skaters to skilled team play with future opportunities at the college level and professional sports.

Aggressive skating is one of the fastest-growing individual segments of inline skating. Freeform dance of risky "aggressive" tricks are performed on rails and ramps with ballet-like motion on inline skates. The sport is urban, extreme and artistic, exuding an attitude emulated by today's youth.

Applicant has developed a sport and a playing surface on which the sport is to be played. This sport as well as the playing surface are described in U.S. patent application Ser. No. 09/112,477, filed Jul. 9, 1998 , U.S. Pat. No. 5,906,595 and U.S. Ser. No. 09/112,476, filed Jul. 9, 1998, U.S. Pat. No. 5,993,735.

This sport is played on a unique playing surface or bowl combining the half-pipe concept of inline skating with the traditional rink playing field of hockey, with the exception that the periphery of the playing field would be curved rather than straight, which is conducive to inline skating. An upper deck planar surface would be provided between the curved ramp surface and the boards which surround the playing surface of conventional roller hockey or ice hockey rinks. The main level playing area would utilize the same floor markings as roller hockey.

The sport would be played by a team of players endeavoring to propel a ball into one of two goals situated on the playing surface. Each player would be equipped with a lacrosse-type stick having a head net portion connected to an elongated handle.

Typical lacrosse stick heads are described in U.S. Pat. No. 3,591,178, issued to Milligan et al; U.S. Pat. No. 5,035,434 issued to Taylor et al; U.S. Pat. No. 5,080,372 issued to Brine II, et al; U.S. Pat. No. 5,494,297 issued to MacNeil; and U.S. Pat. No. 5,568,925, issued to Morrow et al.

However, due to the differences between lacrosse and the sport created by the Applicant, typical lacrosse-type sticks would not be adequate for the newly developed sport. For instance, since the ball would be advanced by tossing it in the air from one teammate to another, as well as rolling the ball on the playing surface, the standard lacrosse stick must be modified to allow the ball to be struck by the lacrosse stick head as well as allowing a player to scoop the ball from the playing surface and into the netted lacrosse stick head.

SUMMARY OF THE INVENTION

The present invention addresses the deficiencies of the prior art lacrosse-type sticks and is directed to a modified lacrosse stick used in a game combining various features of inline skating and lacrosse creating a unique blend of extreme individual skills that rely on expert cohesive team play. This game requires high-speed maneuvers, fast passing and dramatic free-form vertical skills thereby creating a visually exciting experience for the spectator and thrilling and competitive play for the participant. The players use a netted stick similar to a lacrosse stick allowing a ball to be moved along at speeds exceeding that of an ice hockey puck or lacrosse ball. The ball is passed from one player to another using the netted portion of the stick. Additionally, a flange portion is attached to one side of the netted portion allowing the ball to be struck when it is on the playing surface. A lip portion is included allowing the ball to be scooped into the netted head portion of the stick.

Other features and objects of the invention will be apparent from the following detailed description taken in conjunction with the following drawings.

DETAILED DESCRIPTION OF THE DRAWINGS

DETAILED DESCRIPTION OF THE INVENTION

Figure 1:
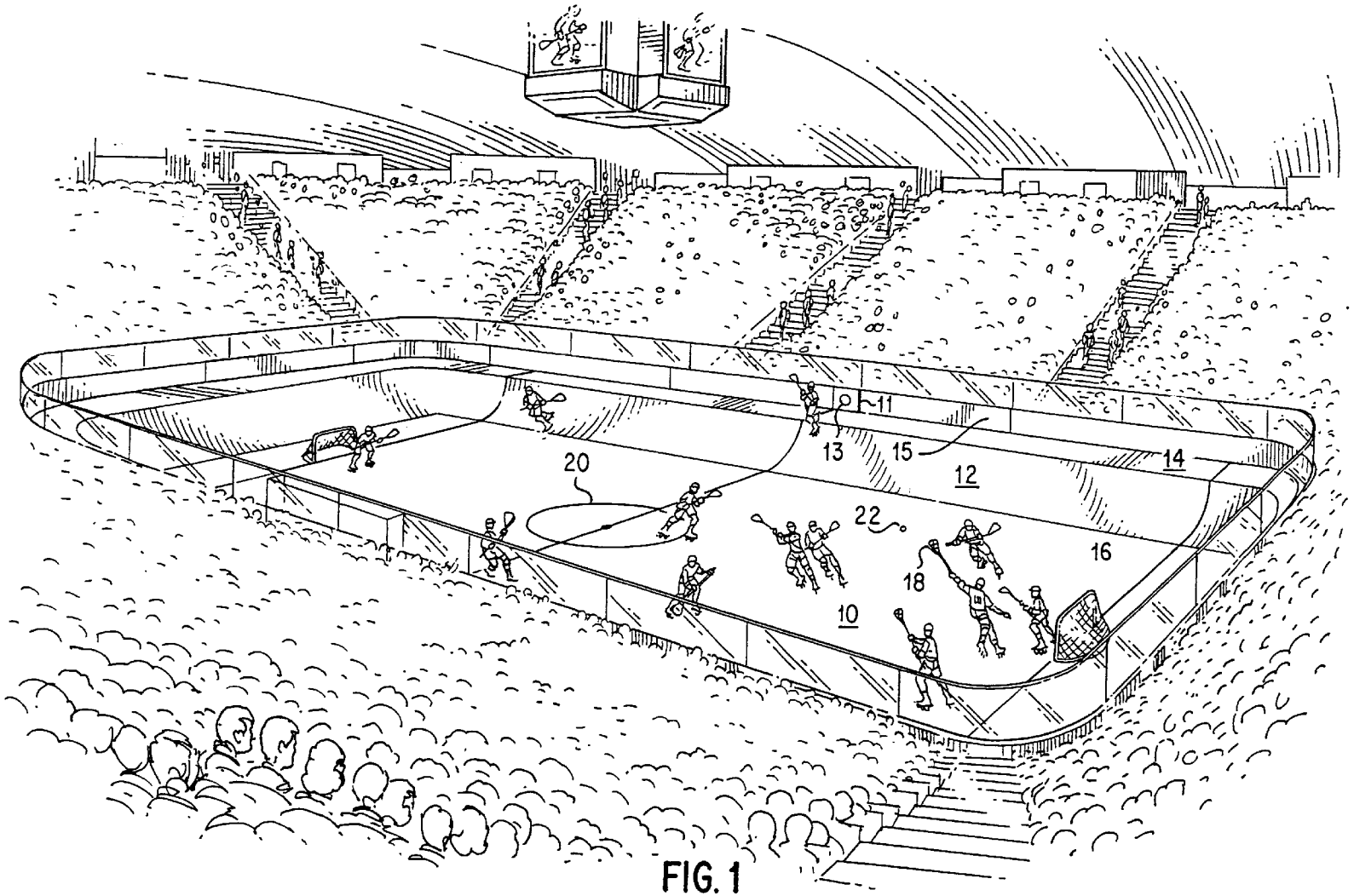
FIG. 1 is a perspective drawing of the roller cross playing surface.
Figure 2:
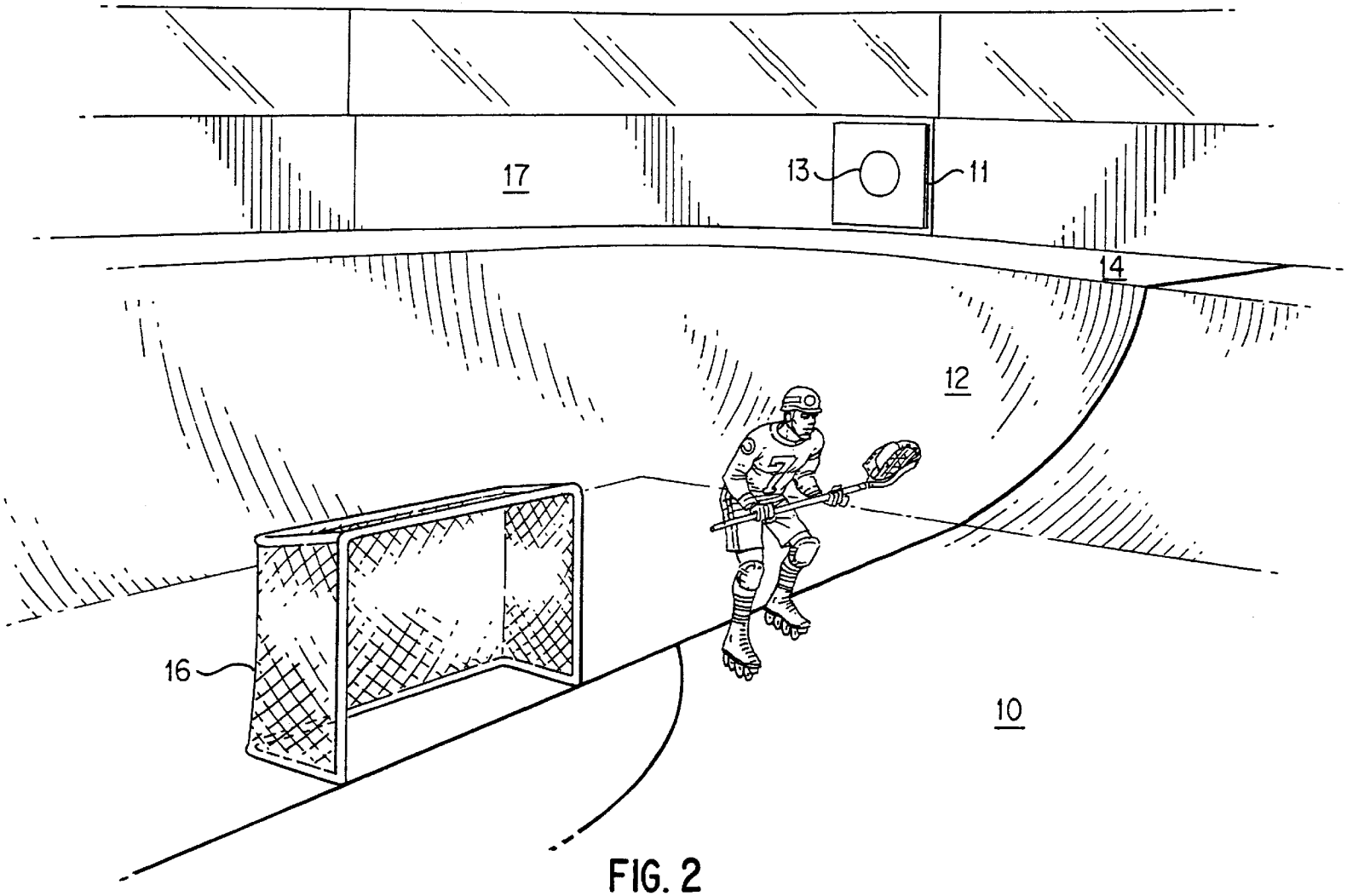
FIG. 2 is a perspective drawing of a portion of the playing surface.
Figure 3:
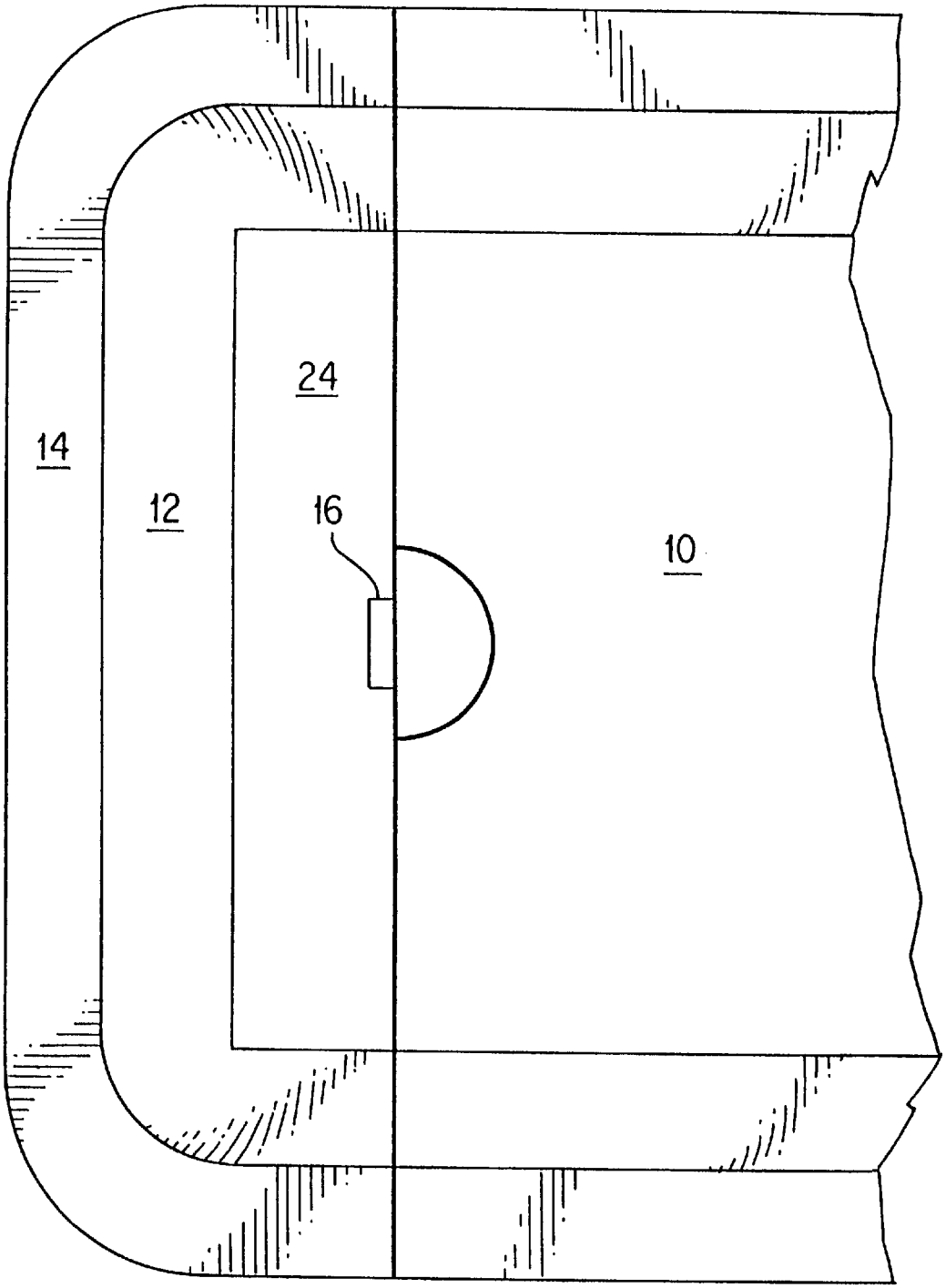
FIG. 3 is a top view showing proposed dimensions of the playing surface.

FIGS. 1–3 illustrate a rink design used to play a rollercross-type game. The rink design includes a planar main playing area 10 extending for the majority of both the length and width of the rink. The periphery of the main rink section 10 is surrounded by a curved ramp section 12. Surrounding the curved ramp 12 is a second planar section 14. Therefore, during play, skaters would utilize the main skating surface 10, the curved ramp "half-pipe" surface 12 as well as the top planer surface 14. The playing surface would include two nets 16 and will be played with lacrosse-type sticks 18 and balls 22. A center face-off circle 20 is provided similar in nature to ice hockey, roller hockey and lacrosse. Furthermore, the main planar surface 10 includes two planar surfaces 24 provided behind each of the nets 16.

Although the exact dimensions of the playing surface are not crucial, FIG. 3 illustrates typical dimensions. It is noted that the rollercross-type game rink or bowl, can fit inside any regulation size ice or in-line rink provided with a playing surface at a minimum of 175 feet by 65 feet or at a maximum of 200 feet by 85 feet. The ramp walls would start approximately six to eight feet from the traditional hockey boards.

Although the rollercross-type game rink or bowl as been described with respect to a game played by participants using inline skates, the type of surface should not be so limited. For example, when used with inline skates, the composition of the playing surface would be similar to that of an inline skating rink or a roller hockey skating rink. However, if the rink as described hereinabove were covered with ice, the players would employ ice skates. In that instance, the game could be played utilizing the same rules as well as equipment employed in ice hockey or could utilize the lacrosse sticks and ball employed in lacrosse.

Figure 4:
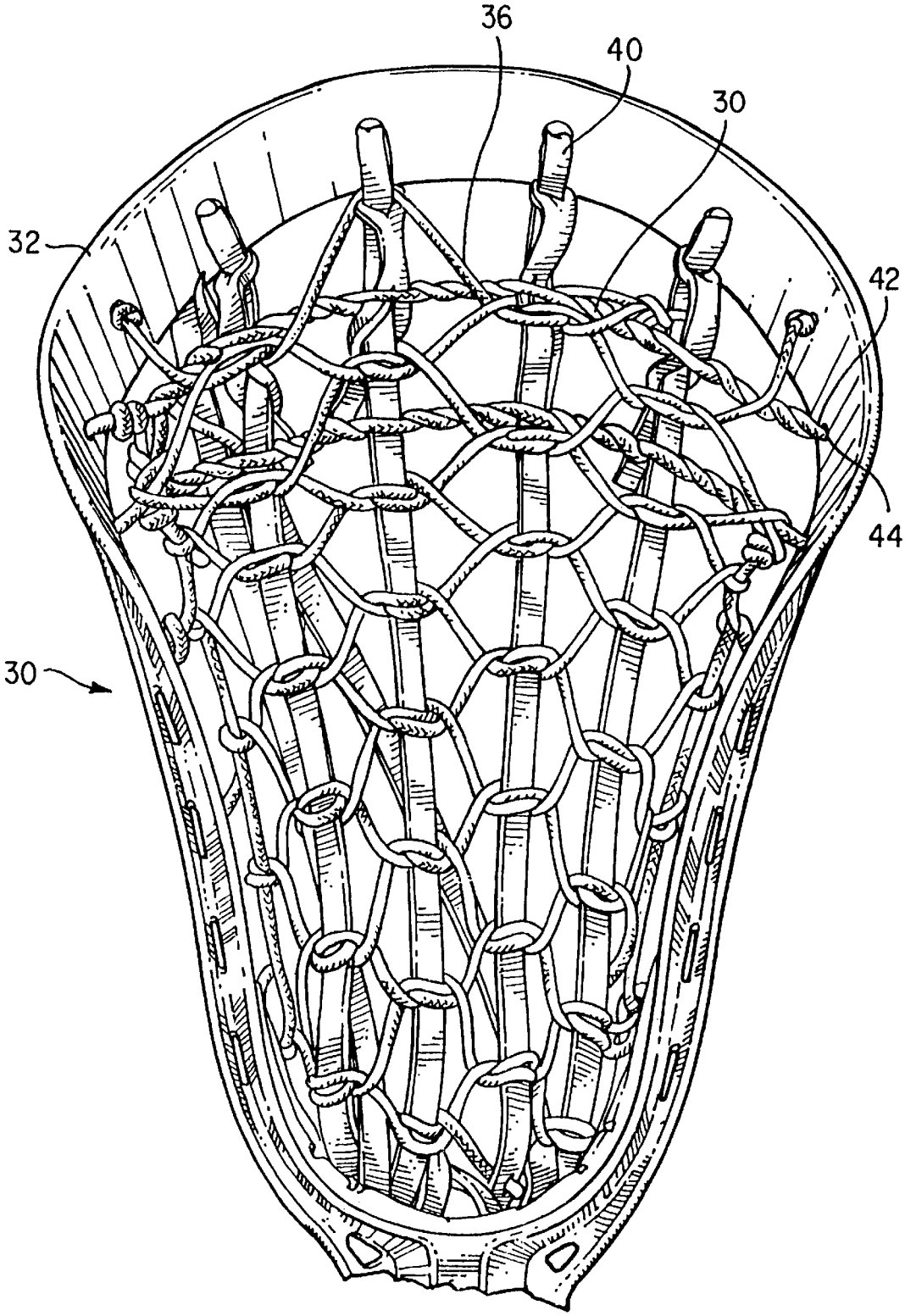
FIG. 4 is a diagram of a standard lacrosse stick net.

FIG. 4 illustrates a standard lacrosse stick netting portion. This portion is used to catch as well as to throw a standard lacrosse ball. Generally, a standard lacrosse stick head portion 30 includes an open shell portion 32 usually constructed from wood, lightweight metal or plastic. A netting 36 is provided within this open shell and consists of a number of vertical netting strips as well as a number of horizontal netting strips 42. Both the horizontal and the vertical strips are attached to the shell as denoted by reference numerals 40 and 44. The net can be constructed from various fibers such as nylon and the like. The portion 30 is then attached to a standard lacrosse stick constructed from wood, lightweight metal or plastic.

Figure 5:
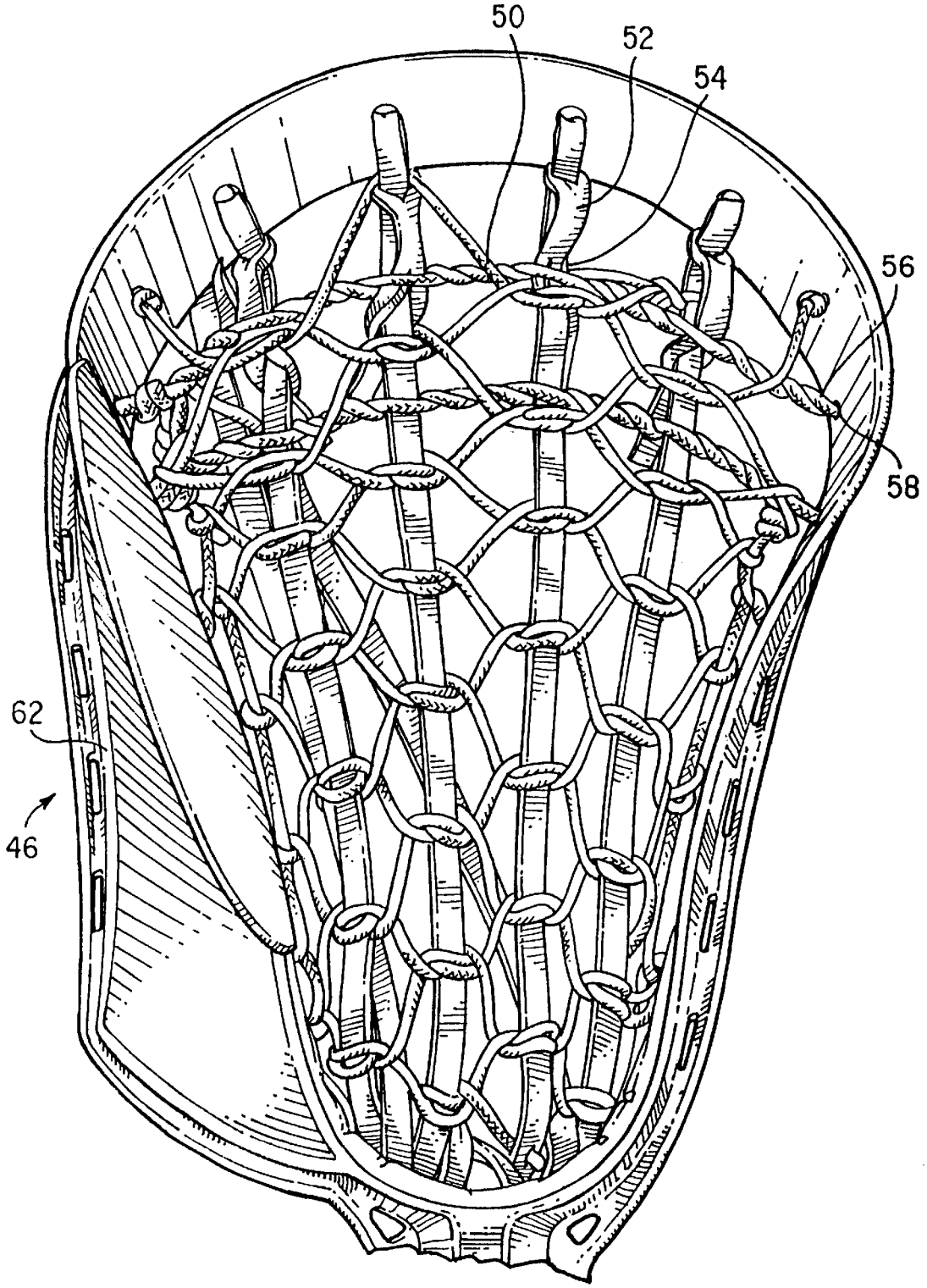
FIG. 5 is a diagram of the modified lacrosse stick net according to the present invention.

FIG. 5 illustrates the lacrosse stick head portion according to the present invention. The lacrosse head 46 is similar to a standard lacrosse head and would include a netting portion 50 attached to and extending across an open outer shell portion. The shell portion is constructed from various materials such as wood, lightweight metal as well as plastic. The netting 50 consists of a plurality of vertical strips 52 and a plurality of horizontal strips 56 forming a netting portion used to catch and throw a lacrosse ball or similar type ball. The vertical strips are connected to the shell as shown by reference numeral 52 and the horizontal strips are connected to shell shown by reference numeral 58. A lip portion 60 (see FIG. 6) is elevated and extends along one side of the shell. This lip is used to scoop the ball from the ground directly into the net portion 50. A flat surface 62 also extends from a side portion of the shell as shown in FIG. 5. This flat surface 62 is provided at an angle of approximately 80° to 110° from the lip 60. The purpose of the flat surface 62 is to allow the player to strike the ball when it is on the ground. Both the lip 60 and the flat surface 62 are constructed from the same material from which the shell 48 is constructed. As shown in FIG. 5, the flat surface 62 can extend for a greater distance along the side portion than the length of the lip 60.

Figure 6:
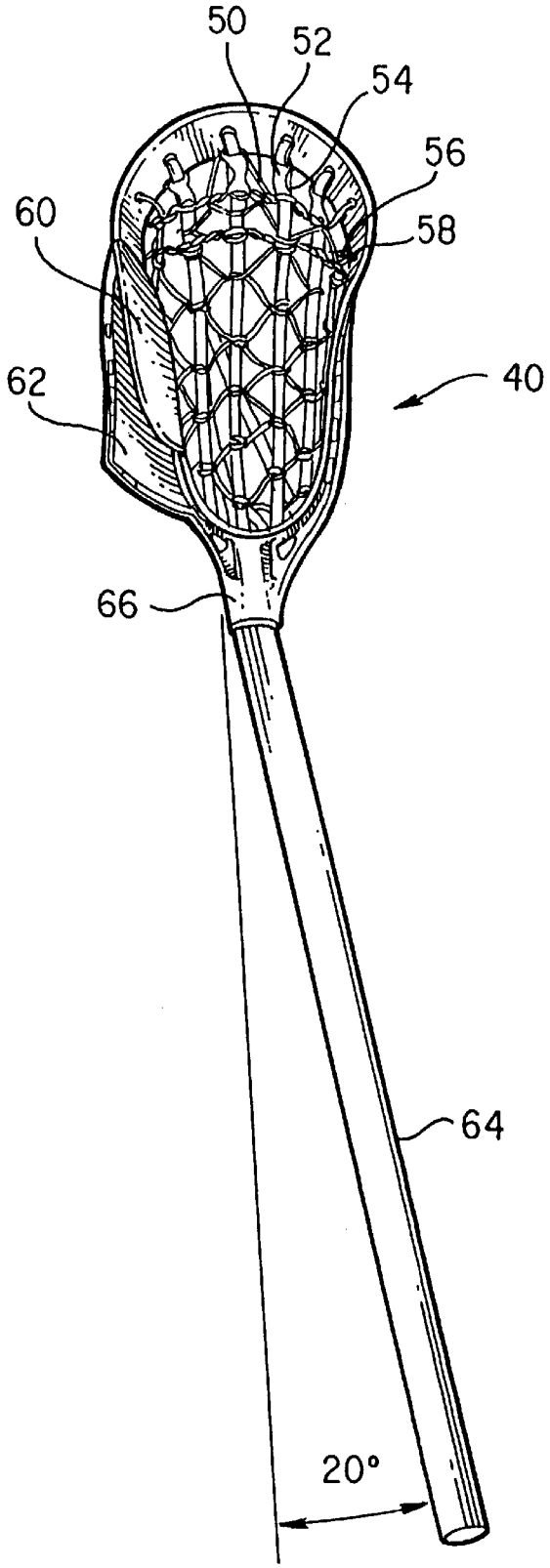
FIG. 6 is a prospective drawing of the entire lacrosse stick including the approximate dimensions of the stick.

FIG. 6 illustrates the netting portion of the present invention as illustrated in FIG. 5 attached to a standard stick 64. Generally, the stick portion 64 is angled approximately 20° with the head portion 46. Furthermore, an approximately 2 inch sleeve 66 fastens the head 46 to the stick 64.

While the foregoing has illustrated and describe what is contemplated to be the best mode of carrying out the present invention, the latter is, of course, subject to modifications without departing from the spirit and scope of the invention. For example, FIGS. 5 and 6 illustrate the lacrosse head with lip 60 and as well as the flat surface 62 affixed to the same side portion of the frame. It is noted that the flat surface 62 could extend from a different side portion of the frame that which the lip 60 extends.

What is claimed is:

1. A lacrosse-type stick head comprising:

a frame having a first height including a top end wall portion, first and second side portions and a bottom neck portion;

a netting attached to said frame; and a lip portion attached to only one of said side portions, said lip portion extending along a portion of the length of one of said side portions and angled therefrom, said lip portion having a second height greater than said first height.

2. The lacrosse-type stick head in accordance with claim 1, further including a flat portion attached to and horizontally extending from one of said side portions.

3. The lacrosse-type stick head in accordance with claim 2, wherein said lip portion and said flat portion are attached to the same side portion.

4. The lacrosse-type stick head in accordance with claim 2, wherein the length of said flat portion is greater than the length of said lip portion.

5. The lacrosse-type stick head in accordance with claim 3, wherein the length of said flat portion is greater than the length of said lip portion.

6. The lacrosse-type stick head in accordance with claim 3, wherein said flat portion is angled 80° to 100° with respect to said lip portion.

7. The lacrosse-type stick head in accordance with claim 5, wherein said flat portion is angled 80° to 100° with respect to said lip portion.

8. A lacrosse-type stick head comprising:

a frame including a top end wall portion, first and second side portions and a bottom neck portion;

a netting attached to said frame; and a flat portion attached to only one of said side portions, said flat portion extending horizontally from the exterior of one of said side portions away from the periphery of said frame and along a portion of the length of one of said side portions.

9. A lacrosse-type stick comprising:

a frame having a first height including a top end wall portion, first and second side portions and a bottom neck portion;

a netting attached to said frame;

a lip portion attached to only one of said side portions, said lip portion extending along a portion of the length of one of said side portions and angled therefrom, said lip portion having a second height greater than said first height;

a sleeve portion attached to said frame; and a handle attached to said sleeve portion.

10. The lacrosse-type stick in accordance with claim 9, wherein said neck portion has a longitudinal axis and said handle is angled with respect to said longitudinal axis.

11. The lacrosse-type stick in accordance with claim 10, wherein said angle between said handle and said neck Portion is approximately 20°.

12. The lacrosse-type stick head in accordance with claim 9, further including a flat portion attached to and horizontally extending from the exterior of one of said side portions and away from the periphery of said frame.

13. The lacrosse-type stick head in accordance with claim 10, further including a flat portion attached to and horizontally extending from the exterior of one of said side portions and away from the periphery of said frame.

14. The lacrosse-type stick head in accordance with claim 12, wherein said lip portion and said flat portion are attached to the same side portion.

15. The lacrosse-type stick head in accordance with claim 14, wherein the length of said flat portion is greater than the length of said lip portion.

16. The lacrosse-type stick head in accordance with claim 15, wherein said flat portion is angled 80° to 100° with respect to said lip portion.

17. A lacrosse-type stick comprising:

a frame including a top end wall portion, first and second side portions and a bottom neck portion;

a netting attached to said frame;

a flat portion attached to only one of said side portions, said flat portion extending horizontally from the exterior of one of said side portions and away from the periphery of said frame and along a portion of the length of one of said side portions;

a sleeve portion attached to said frame; and a handle attached to said sleeve portion.

* * * * *